United States Patent [19]

Gilcher

[11] 4,407,470

[45] Oct. 4, 1983

[54] CODE RESET APPARATUS FOR RAILROAD TRACK CIRCUITS

[75] Inventor: Heinz Gilcher, Export, Pa.

[73] Assignee: American Standard Inc., Swissvale, Pa.

[21] Appl. No.: 295,197

[22] Filed: Aug. 21, 1981

[51] Int. Cl.[3] ..... B61C 21/06

[52] U.S. Cl. ..... 246/34 R; 246/28 K; 246/122 R

[58] Field of Search ..... 246/34 R, 34 A, 34 B, 246/34 D, 34 C, 34 CT, 122 R, 28 K, 41, 42, 61, 72, 81

[56] References Cited

U.S. PATENT DOCUMENTS

| | | | |
|---|---|---|---|
| 1,653,358 | 12/1927 | Gilson | 246/34 A |
| 1,810,940 | 6/1931 | Baughman | 246/34 R |
| 1,822,088 | 9/1931 | Hailes | 246/34 R |
| 3,217,158 | 11/1965 | Ehrlich | 246/34 R |
| 3,263,074 | 7/1966 | Ihrig | 246/34 R |
| 4,171,788 | 10/1979 | Nagel | 246/34 R |
| 4,188,002 | 2/1980 | Gilcher | 246/34 R |

*Primary Examiner*—James J. Groody

*Attorney, Agent, or Firm*—A. G. Williamson, Jr.

[57] ABSTRACT

Coded energy applied to the track circuit rails for cab signal control when a train occupies the section is also applied over a line circuit to the local input of the solid state track relay unit and to a code reset module in which it drives a code following relay and charges a timing capacitor during a predetermined number of code pulses. When the section becomes unoccupied, the track relay unit produces a coded output, from the combined rail and local inputs, to which the track registry relay is non-responsive. An analog storage circuit in the reset module receives and stores this coded output energy during each timing period. During each code off-time, the timing capacitor is connected to a switching relay circuit controlled by a DIAC unit. At the completion of the timing period, sufficient charge exists on the timing capacitor to activate the DIAC unit during the next code offtime and energize the switching relay which completes a circuit for discharging the analog voltage storage through the track relay to supplement the coded energy from the track relay unit. The track registry relay then receives sufficient energy to pick up and reset the track circuit to its normal steady energy condition.

5 Claims, 3 Drawing Figures

CODE RESET APPARATUS FOR RAILROAD TRACK CIRCUITS

FIELD OF THE INVENTION

My invention pertains to code reset apparatus for railroad track circuits. More particularly, the invention pertains to a circuit arrangement for resetting a track circuit, which incorporates a solid state track relay unit, to the normal steady energy condition after a period of coded operation for cab signal control.

BACKGROUND OF THE INVENTION

Solid state relays are being substituted for older style, obsolescent track relays in alternating current (AC)-track circuits, particularly where a shift in the frequency of electric propulsion power is planned. One such relay arrangement is disclosed in my U.S. Pat. No. 4,188,002, issued Feb. 12, 1980 for a "Vital Power Varistor Circuit for Railroad Signaling Systems". Normally such track circuits are energized with a steady alternating current, obviously of the frequency to which the solid state track relay apparatus is tuned and to which it responds. In some locations, however, the track current must be coded when the corresponding track section is occupied to activate and control cab signal apparatus on board the train. When the train clears the section, the track circuit must then reset to steady energy. However, many of the solid state relay units, particularly the one disclosed in the cited patent, are not designed to fully respond to coded current to detect a departure of the train. Some additional element or apparatus must be provided to assist or actuate the solid state relay to respond to coded energy to initiate the reset or restoration of the track circuit to steady current. Obviously, such additional apparatus must be compatible with the solid state relay arrangement and of simple, efficient, yet reliable and vital design.

Accordingly, an object of my invention is code reset apparatus for railroad track circuits which include a solid state track relay arrangement.

Another object of the invention is a circuit network for detecting coded track current, following the passage of a train through a track circuit, to actuate a response by a solid state track relay which initiates the reset of the track circuit to restore its normal steady energy condition.

A further object of the invention is apparatus supplementing a solid state track relay means in an alternating current track circuit and which stores energy from successive code pulses received following the passage of a train through the track section and discharges that stored energy so synchronized as to augment the code pulses to sufficiently energize the track relay, which is nonresponsive to coded energy, to actuate a response which restores the track circuit to a steady energy condition.

Yet another object of my invention is code reset apparatus for an AC track circuit, which is normally supplied with steady energy from the source and is supplied with coded energy during the passage of a train through the section, including a timing circuit which accumulates a charge from the code pulses received from the track circuit source, a switching circuit responsive, when complete, to a predetermined level of stored timing energy to energize a first relay, a second relay connected to respond to the code pulses from the source to periodically complete the switching circuit at the end of each code pulse so that the first relay is energized during a code off-period, an analog storage network accumulating voltage signals from the track relay means, as code pulses are received through the track and line circuit, and controlled by the first relay to release its energy storage to supplement the energy received by the track relay during coding operation and initiate a reset of the track circuit transmitter to steady energy.

Other objects, features, and advantages of my invention will become apparent from the following specification and appended claims when taken in connection with the accompanying drawings.

SUMMARY OF THE INVENTION

The apparatus herein disclosed supplements the solid state track relay means, for example of the type disclosed in the cited prior patent, to assist its response to coded track and line circuit energy to reset the track circuit to steady energy after the passage of a train through the corresponding track section. A requirement exists for such apparatus when the normal steady energy of an alternating current track circuit is replaced by coded energy in the rails to control cab signals when a train moves through the track section. This code reset network is coupled to the alternating current source of track energy by a series tuned LC filter and saturable transformer which together form a saturable transformer voltage regulator. Steady energy is normally received from the source but at times this energy is coded at a preselected rate. One relay of the unit is connected to receive energy from the transformer secondary in the form of rectified half-cycle waves of one polarity. During code operation, this relay is periodically energized by the rectified pulses and follows the code, that is, periodically picks up and releases. A timing circuit is also connected to the transformer secondary to receive rectified half-cycle waves of the other polarity. The timer is an RC circuit with voltage or energy buildup on the capacitor during the successive code pulses. Completion of each time period is registered by a switching relay network which is periodically connected to the timer by a released position contact of the code following relay. This switching network includes a DIAC element with a preselected switching voltage. When the timing requirement is met, the voltage level on the timer capacitor, at the instant of the release of the code following relay, is at least equal to the switching voltage of the DIAC element, which conducts so that the switching relay is energized and picks up to briefly register the completion of that timing period. This action, of course, occurs even though the track section is occupied by a train since input through this network is from the local AC source, i.e., from the main source over a line circuit from the exit end of the track section.

Meanwhile, when the train has cleared the track section, the solid state module of the track relay unit responds to the coded track and line circuit energy to output direct current code pulses. However, these contain insufficient energy to actuate the vital track relay which registers the occupancy condition of the track circuit. In other words, this relay does not pick up to register the reception of the coded energy. The invention adds an analog storage network to receive and accumulate the code pulse output from the solid state unit. This analog network also includes an energized position contact of the switching relay so connected that when closed it applies the stored energy to the vital track relay. This action occurs during an off-period of the received code since this switching relay picks up when the code following relay releases. Discharge of the accumulated energy is used to supplement or fill in the coded energy applied to the vital relay from the solid state module and this relay then is sufficiently energized to pick up. This registers the unoccupied condition of the track circuit and further resets the track circuit apparatus so that the coded energy is replaced by the normal steady energy in both the rails and the line circuit which restores the track circuit to its normal condition.

BRIEF DESCRIPTION OF THE DRAWINGS

Before defining the invention in the appended claims, I will describe in more detail a specific arrangement embodying the invention as illustrated in the accompanying drawings in which:

In each of the drawings, the same or similar reference characters designate similar parts of the apparatus.

DESCRIPTION OF THE ILLUSTRATED EMBODIMENT

Figure 1:
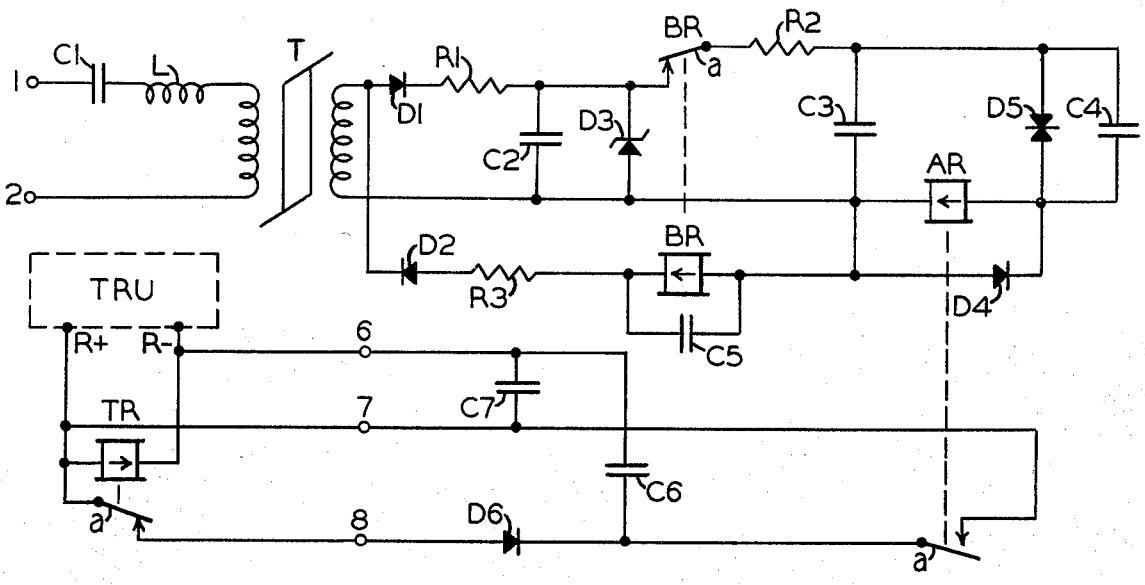
FIG. 1 is a schematic circuit diagram of code reset apparatus embodying the invention.

Referring first to FIG. 1, which shows the code reset apparatus embodying the invention, the solid state track relay unit with which the apparatus primarily cooperates is shown by a conventional dash line block labeled TRU. A specific example is shown in the previously cited U.S. Pat. No. 4,188,002 and only the necessary details are illustrated herein, such as the vital track registry relay TR which is connected to the output terminals R+ and R− to receive operating energy. It will be noted that a similar conventional showing of unit TRU is used in FIG. 2. Except for unit TRU and relay TR, the remainder of the apparatus illustrated in this drawing figure is normally packaged in a modular arrangement or style with the terminals shown. Terminals R+ and R− of the relay unit are also connected to terminals 7 and 6, respectively, of the reset apparatus module. A back contact a of relay TR is connected to terminal 8 of this module with the associated armature or heel contact connected directly to terminal R+.

Power or energy is input to the reset module across its terminals 1 and 2. This is the same local signal received by unit TRU and is normally a steady alternating current energy, for example, of 110V and 100Hz frequency. At times this input energy is coded at a selected track code rate, as will be discussed later in connection with FIG. 2. It is to be understood that when both inputs to unit TRU are coded and of proper relationship, a coded direct current output of the proper polarity appears across the terminals R+ and R− as illustrated, for example, in graph D of FIG. 3. However, relay TR is not responsive to such coded energy and does not pick up.

The input applied to the code reset module is applied through capacitor C1 and inductor L which form a series tuned filter network. This network is connected in series with the primary of saturable transformer T and together they provide a saturable transformer voltage regulator. The apparatus includes two relays, a first relay AR and a second relay BR. Each of these relays are of the biased type, as designated by the "arrows" within the winding symbols, but need not be vital relays. However, they should be reliable enough to provide a long life under frequent operations, for example, under code following operation. Relay BR does act as a code following relay when the input to the module across terminals 1 and 2 is coded. This relay functions on selected polarity half wave rectified current from the secondary of transformer T, for example, the negative half cycles of the transformer output. This circuit may be traced from the lower terminal of the secondary winding through the winding of relay BR in the direction of the arrow, resistor R3, and diode D2, polarized for this direction, to the upper terminal of the secondary winding. Resistor R3 and capacitor C5, connected in multiple with the relay winding serve as a smoothing filter in this energizing circuit. When the input is steady energy, relay BR holds in its picked up condition.

Rectification of the other or positive half cycles of the transformer T secondary output by diode D1 provides a coded DC energy for a timing circuit consisting of resistor R1 and capacitor C2. Operation of this timing circuit cooperates with the switching circuit, for energizing relay AR, which is controlled by a DIAC element D5 and back contact a of relay BR. DIAC D5 has a preselected switching voltage designated as $V_S$ which represents the applied voltage level at which the unit or element begins to conduct. This energizing circuit for relay AR is traced from the upper terminal of capacitor C2 over back contact a of relay BR, resistor R2, unit D5, and the winding of relay AR in the direction of the arrow to the lower terminal of capacitor C2. The full network also includes a capacitor C4 connected in multiple with DIAC D5 as a high frequency bypass circuit. The circuit path through resistor R2 and the capacitor C3 is used to minimize the voltage rate of change applied to element D5. The ZENER diode D3 prevents an excessive voltage level occurring on capacitor C2 when a steady state input condition exists, that is, a noncoded input.

Figure 3:
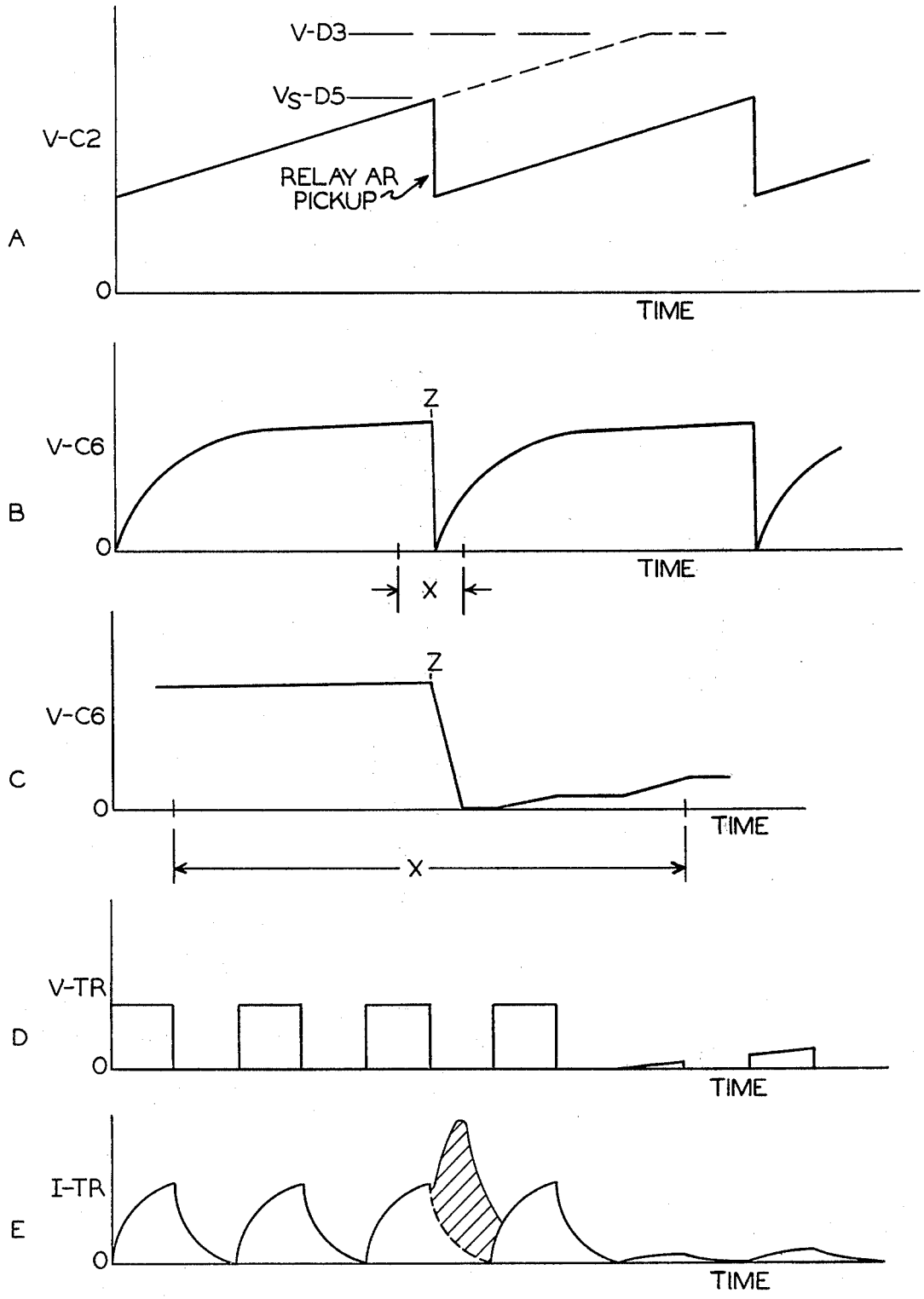
FIG. 3 consists of charts or graphs A to E which show the distribution of the energy at various locations within the code reset apparatus and which are useful in explaining the operation of the arrangement embodying the invention.

When the input to the unit is coded energy, positive rectified pulses charge capacitor C2 in the manner shown in chart or graph A of FIG. 3. Periodically, back contact a of relay BR closes during this charging action but while the voltage stored on capacitor C2 is less than the switching voltage $V_S$ of DIAC D5, no action occurs. However, when the stored voltage on capacitor C2 is equal to or greater than voltage level $V_S$, the discharge of the capacitor is commutated by back contact a of relay BR so that capacitor C2 discharges to energize relay AR through diode D5 at the end of a code pulse, that is, during a code off-time of the received signal. In one specific design, the timing period to charge capacitor C2 to this level is on the order of 6 to 10 seconds and thus includes a number of code pulses.

An analog storage network is also part of the reset module and includes capacitor C6, diode D6, and back contact a of relay TR which is outside the actual module itself as represented by terminals 6, 7 and 8. This series circuit is connected in multiple with the winding of relay TR across terminals R+ and R− of the track unit TRU with diode D6 so poled as to charge capacitor C6 by the coded output of this track unit. Capacitor C7 serves as a bypass for any harmonic signals in the TRU output. A typical charging cycle for capacitor C6, when a full coded output as in FIG. 3D is produced by element TRU, is illustrated in graph B of FIG. 3. It should be understood that the voltage scale in the vertical axes in the graphs of FIG. 3 is illustrative only, there being no direct relationship to each other or to any actual values. It is also noted that the time axes of graphs A and B are identical in scale and that the events illustrated are synchronized. However, the time scale on the horizontal axes is expanded in the other graphs C, D, and E, with a relationship and the order of the time periods X marked in graphs B and C. The timed events in the latter three graphs C, D, and E are also synchronized in the illustration. In graphs B and C, the two time periods X illustrated for purposes of showing the expansion are both centered on the point Z, at which the voltage charge on capacitor C6 reaches its maximum and the discharge begins.

When the timing period is complete, so that capacitor C2 stores sufficient charge, i.e., $V_S$, relay AR picks up with the next release of relay BR to close its back contact a. The closing of front contact a of relay AR then completes a discharge circuit for capacitor C6 traced from the lower terminal of this capacitor, which has a relative positive polarity, over front contact a of the relay AR, terminal 7 of the module, the winding of relay TR in the direction of the arrow, and terminal 6 of the module to the upper terminal of capacitor C6. This is illustrated in graph B by the rapid reduction, i.e., discharge, of the voltage on capacitor C6 from the peak point Z to the zero level. Disregarding any reset action to be later discussed, capacitor C6 would then immediately begin to recharge since the picked up period for relay AR is relatively brief, extending no more than one code period off-time as a maximum, that is, until relay BR again picks up at the next code pulse.

Shifting to graph C, the same discharge of capacitor C6 is shown on the expanded time scale. Since the time scale is expanded approximately 10 times, the recharge of capacitor C6 is illustrated in increments as each code pulse is output from unit TRU. It should be understood that, as will be subsequently described, if the reset action of the track circuit properly occurs at this point, with the train having cleared section 1T the further recharging of capacitor C6 as illustrated in either graph B or graph C will not occur. In graph D, which has the same time scale as graph C, the code signal envelope of the TRU output under coded input conditions is illustrated. Graph E illustrates the wave form of the input current for relay TR when the TRU output is of coded form. In both of these latter two graphs, the illustrated wave forms occur when both inputs to unit TRU, that is, both track and local, are receiving input code pulses. In other words, the relative voltage or current levels shown in graphs D and E represent the condition immediately after the train clears section 1T. Since the discharge of capacitor C6 occurs during an off-period of the input code, due to the commutation provided by back contact a of relay BR, the discharge energy provides a fill-in current shown in the shaded pulse in graph E, which adds to the energization of the winding of relay TR in sufficient amount to momentarily pick up relay TR. For illustration only, in the event that relay TR does not pick up in the first discharge cycle of capacitor C6, the low impedance of the discharged capacitor combined with the high internal output impedance of unit TRU will cause its output to fall to a very low level and gradually increase as illustrated by the envelopes of the two, low level code pulses shown at the right of each of graphs D and E.

Figure 2:
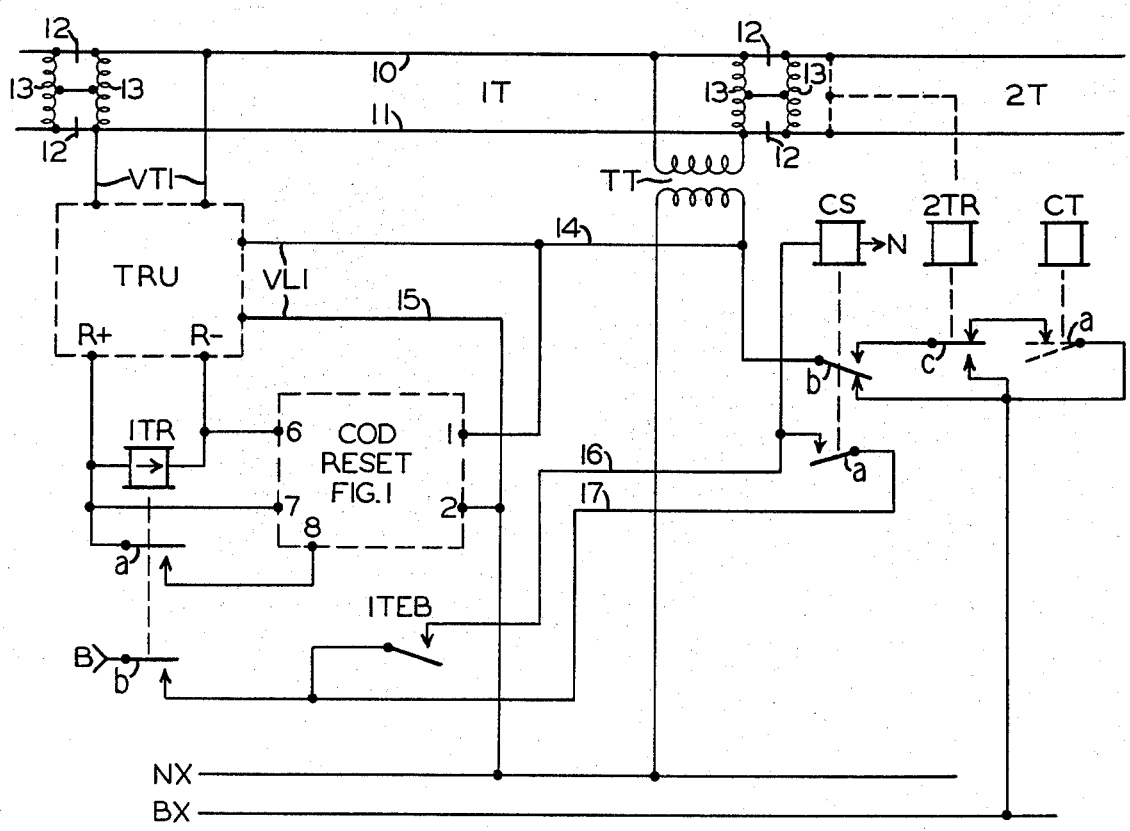
FIG. 2 is a conventional block and schematic circuit diagram of a railroad track circuit arrangement incorporating a solid state track relay element and employing the code reset apparatus of my invention as illustrated in FIG. 1.

A description of the operation of a typical track circuit using code reset apparatus as shown in FIG. 2 will further explain the function and purpose of the reset module. Across the top of this drawing is a stretch of railroad track including the rails 10 and 11, each shown by conventional single line representation. This track is divided into insulated sections by conventionally shown insulated joints 12, a track section 1T being fully shown and a section 2T partially at the right. For simplicity in the explanation, trains are assumed to move only from left to right through this track although no wayside signals are actually shown. The insulated joints are bypassed, for the purpose of providing a return circuit through the rails for AC propulsion energy, by impedance bonds illustrated by the windings 13 across the rails on each side of each pair of joints 12 with the center taps of such windings connected. All these elements and apparatus are conventional and their use is well understood. Across the bottom of FIG. 2 is illustrated an alternating current source for the track circuits. The representation is of two line wires extending alongside the track, the actual source being indicated by the conventional references BX and NX. For example, the source may be one having a frequency of 100 Hz and a voltage level of 110 volts.

Section 1T is provided with a track circuit using solid state relay means of the prior cited patent designated by the dash line block TRU and the vital track relay TR. The unit TRU is connected across the rails at the entrance end of section 1T to receive an input signal VT1 and, as will be explained, across a local source of AC energy to receive an input signal VL1. The track circuit is normally supplied by steady alternating current energy from the source across the rails at the exit end of section 1T. This energy flows through the rails and is received by unit TRU as the input signal VT1. A local input signal VL1 is applied to the TRU across the leads 14 and 15 from the AC source BX and NX as will be shortly explained. As will also appear, lead 14 is actually a wayside line wire extending from the exit end. These two leads 14 and 15 also provide the code reset unit of FIG. 1, shown here by conventional dash line block, with input energy across its terminals 1 and 2.

The track section 2T partially shown at the right is also provided with an alternating current track circuit but only the entrance end apparatus needed for an explanation of this invention is shown. A track relay 2TR is shown conventionally connected across the rails, for example, in the same manner as relay 1TR but not necessarily so, to respond to section occupancy. This relay is picked up when the section is unoccupied by a train and releases to register the presence of a train within section 2T in a manner similar to the actual operation of relay 1TR. A code transmitter is provided at this location, shown by the relay symbol designated CT, which is energized to continuously operate its contacts to periodically close front contact a at an assumed 50% on-time at a selected code rate, which for example may be between 75 and 180 times per minute. Such apparatus is well known in the signaling art. A third relay is also provided at this entrance end of section 2T, the cab signal control relay CS which is used to shift the energy supplied to the section 1T track circuit from a steady to coded form. The energizing circuit for relay CS extends from positive terminal B of a local direct current source over back contact b of relay 1TR, a contact 1TEB, line wire 16, and the winding of relay CS to the opposite terminal N of the DC source. Contact 1TEB is a conventional representation of the traffic control for trains moving through the track and is closed when a train movement through section 1T is authorized. This contact opens, when a train actually enters section 1T, following a short slow release time period. Thus when the section is occupied and relay 1TR also releases, the closing of its back contact b completes the energizing circuit for relay CS. This relay picks up to complete a stick circuit at its front contact a from back contact b of relay 1TR prior to the time that contact 1TEB opens.

Under normal at-rest conditions when relay CS is released, the supply of energy to the rails of section 1T is provided over the circuit traced from line wire BX over back contact b of relay CS and the primary winding of a track transformer TT, returning to line wire NX. With the secondary of transformer TT connected across rails 10 and 11 of section 1T, steady energy is thus applied to this rail circuit. When relay CS is picked up and relay 2TR is also picked up with section 2T unoccupied, the supply of energy to the rails is provided by the circuit from line wire BX over coding contact a of transmitter CT, front contact c of relay 2TR, and front contact b of relay CS to the primary of transformer TT. It will be noted that, if relay 2TR is released to register an occupied section 2T, only steady energy can be provided to the rails of section 1T over back contact c of this track relay and front contact b of relay CS. It will also be noted that whatever energy is being supplied to the primary of transformer TT is also applied to line wire 14 extending to the entrance end of section 1T where lead 15 provides the return to the source terminal NX.

Summarizing, when an authorized train enters section 1T and shunts the rails 10 and 11, relay 1TR releases. This completes the circuit for energizing relay CS which picks up and then sticks. Front contact b of relay CS closes to apply coded energy to the rails of section 1T for control of the train carried cab signals if section 2T is unoccupied by a train. The coded energy is also supplied over leads 14 and 15 to the local input terminals of unit TRU as the local signal VL1. However, substantially all current input from the rails is shunted away by the train axles from the track input terminals VT1 of this unit so that the output from unit TRU at this time is far insufficient to energize relay TR even if it were not a coded input signal. In my cited prior U.S. Pat. No. 4,188,002, the FIG. 3 chart illustrates the very low current output to relay TR which is produced when only the local input is present, and the large increase which occurs when the track input is added.

The same coded energy on leads 14 and 15 is applied to the code reset unit at its input terminals 1 and 2. As previously explained, relay BR follows this applied coded energy and another portion of the rectified output from transformer T is stored in capacitor C2 to measure a predetermined time period. Reference is made to graph A of FIG. 3 to show this action. As long as the train is occupying section 1T, capacitor C2 is periodically charged during each timing period. When the switching voltage $V_S$ of DIAC element D5 is exceeded, upon the next closing of back contact a of relay BR, capacitor C2 discharges through the winding of relay AR to energize this relay periodically. On graph A, it is to be noted that, if steady energy is being received so that relay BR is held energized, ZENER diode D3 limits the upper level of the charge stored in capacitor C2. Back contact a of relay 1TR, of course, is also closed to complete the analog storage circuit between terminals 6 and 8 of the code reset unit but little, if any, energy is stored in capacitor C6 under these conditions since the output at terminals R+ and R− of unit TRU is very low. In other words, the envelope level of the code pulses output from unit TRU as illustrated in graph D is very low. Thus, when relay AR picks up, there is very little supplemental energy applied from capacitor C6 to relay 1TR in the manner illustrated in graph E. In other words, relay 1TR does not pick up during this interval under the conditions existing as long as the train occupies section 1T.

When the train clears section 1T, both coded track and line circuit energy are applied to unit TRU. Coded energy continues to be also applied to terminals 1 and 2 of the reset module. Output at terminals R+ and R− of unit TRU is now at the normal level shown in graph D of FIG. 3 while the current pulse input to relay 1TR is in accordance with the unshaded portion of graph E of this figure. However, this provides insufficient energy to pick up track relay 1TR. The analog storage network now charges capacitor C6 with the energy received from unit TRU in the manner shown in graph B of FIG. 3. At the end of the timing period set by capacitor C2, when relay BR next releases, relay AR receives the energy from capacitor C2 and picks up. The closing of front contact a of relay AR completes the discharge circuit for capacitor C6, the energy flowing in the circuit through the winding of relay 1TR as previously described. This action occurs during the off-time of the code pulses received from the exit end of the section and the flow of energy supplements that provided to relay 1TR from unit TRU as illustrated in graph E of FIG. 3. In other words, the additional energization provided by that energy stored in capacitor C6 fills in the gap between the current pulses flowing through the relay winding so that relay 1TR is sufficiently energized to pick up.

In FIG. 2, the opening of back contact b of relay 1TR at this moment deenergizes relay CS at the exit end and the coded energy is replaced by steady energy in both the track rails and the line circuit. The output of unit TRU is now sufficient to hold relay 1TR fully energized and picked up. Thus the track circuit is restored to its normal condition with rail section 1T unoccupied. In other words, a steady energy is supplied to both rails and line of track section 1T. This reset of the track circuit, after the train clears track section 1T, occurs within the time period established by the timing network including resistor R1 and capacitor C2, for example, within 6 to 10 seconds in accordance with the code rate.

The apparatus of the invention thus provides a simple yet efficient arrangement whereby coded track energy, for cab signals on passing trains, is used to reset a track circuit to its normal steady energy condition when a train clears the section. The coded energy output by the solid state track relay module is stored for a timing period established by the code pulses. The stored energy is then used to supplement the coded output of the track relay unit with its application commutated to fill in the off-period of the code to extend the energy buildup in the track relay to actuate its full pickup. This resets the track circuit transmitter to steady energy and restores the normal track circuit conditions. This is accomplished in an economical and reliable manner.

Although I have herein shown and described but one specific arrangement of code reset apparatus for track circuits, it is to be understood that various changes and modifications therein, within the scope of the appended claims, may be made without departing from the spirit and scope of my invention.

Having thus described the invention, what I claim as new and desire to secure by Letters Patent, is:

1. Code reset apparatus for an alternating current track circuit for a railroad track section normally supplied with steady energy but at times selectively supplied with coded energy from an alternating current source coupled to the section rails at the exit end, said track circuit including a track relay means with high output impedance coupled to said rails and to said source and normally responsive only to steady energy to register an unoccupied section, comprising, (a) a code following relay coupled to said source and responsive to coded energy for periodically closing a contact at the received code rate, (b) a timing means coupled to said source for storing coded energy to measure a predetermined time period, (c) a switching means coupled to said timing means by said code following relay only during coded energy off-periods and responsive to the energy stored in said timing means only when a preselected level is exceeded for closing a contact, and (d) a storage means coupled to said track relay means for storing its coded energy output when the section is unoccupied during said timing period, (e) said storage means controlled by said switching means for supplying the stored energy, when said switching means contact is closed, to actuate a response by said track relay means to said coded energy for resetting said source to supply steady energy to said track circuit.

2. Code reset apparatus as defined in claim 1 in which said switching means comprises, (a) a switching relay having a normally open contact closed when that relay is energized, (b) a DIAC element responsive to a preselected level of applied voltage for conducting current in the corresponding polarity direction, (c) said switching relay and said DIAC element coupled in series to said timing means by said code following relay contact, closed during coded energy off-periods, and (d) said DIAC element responsive to completion of the series circuit during code off-periods for energizing said switching relay when the energy stored by said timing means exceeds said preselected level upon the completion of said predetermined time period.

3. Code reset apparatus as defined in claim 2 in which said timing means comprises, (a) a first diode, (b) a resistor and a capacitor connected in a series timing circuit coupled by said first diode to said source for receiving a plurality of coded half-cycle rectified energy pulses of preselected polarity to measure said predetermined time period, and in which, (c) said code following relay is coupled to said source by a second diode for receiving coded half-cycle rectified energy of opposite polarity.

4. Code reset apparatus as defined in claims 1 or 3 in which said storage means comprises, (a) a third diode, (b) a second capacitor coupled by said third diode to said track relay means for storing the coded energy output when said track section is initially unoccupied following a train occupancy, and (c) said second capacitor also controlled by said switching relay for applying its stored energy to said track relay means when said switching relay is energized to actuate a full response by said track relay means to track circuit coded energy to restore said source to a steady energy condition.

5. Code reset apparatus as defined in claim 4 which further includes an input means comprising, (a) a series inductor-capacitor filter network tuned to the frequency of said source, (b) a saturable transformer having a primary winding coupled across said source by said filter network for regulating the input voltage, and (c) a secondary winding of said transformer coupled for supplying energy from said source through said first and second diodes to said timing means and said code following relay, respectively.

* * * * *